US005086597A

United States Patent [19]

Kelley et al.

[11] Patent Number: 5,086,597

[45] Date of Patent: Feb. 11, 1992

[54] WORK SPACE MANAGEMENT SYSTEM HALLWAY WALL ARRANGEMENT

[75] Inventors: James O. Kelley, Spring Lake, Mich.; William E. Stumpf, Minneapolis, Minn.

[73] Assignee: Herman Miller, Inc., Zeeland, Mich.

[21] Appl. No.: 481,167

[22] Filed: Feb. 20, 1990

[51] Int. Cl.[5] ..... E04H 1/00

[52] U.S. Cl. ..... 52/239; 52/241

[58] Field of Search ..... 52/239, 238.1, 240, 52/241, 221, 481; 160/135, 351

[56] References Cited

U.S. PATENT DOCUMENTS

| | | | |
|---|---|---|---|
| 3,078,968 | 2/1963 | Frick | 52/241 |
| 3,370,389 | 2/1968 | Macaluso | 52/239 |
| 3,570,200 | 3/1971 | Ritner | 52/241 X |
| 3,745,732 | 7/1973 | Pritchard et al. | 52/241 X |
| 3,886,376 | 2/1975 | Nelsson | 52/241 |
| 4,356,672 | 11/1982 | Beckman et al. | 52/238 X |
| 4,535,577 | 8/1985 | Tenser et al. . | |
| 4,567,698 | 2/1986 | Morrison | 52/239 X |
| 4,685,255 | 8/1987 | Kelley et al. . | |
| 4,832,152 | 5/1989 | Schuelke et al. . | |
| 4,833,849 | 5/1989 | Williams et al. | 52/481 X |
| 4,860,812 | 8/1989 | DePietro et al. | 52/239 X |
| 4,874,322 | 10/1989 | Dola et al. | 52/239 X |
| 4,876,835 | 10/1989 | Kelley et al. . | |

FOREIGN PATENT DOCUMENTS

| | | | |
|---|---|---|---|
| 1137278 | 5/1957 | France | 52/239 |
| 0714002 | 8/1954 | United Kingdom | 52/238.1 |

OTHER PUBLICATIONS

Teknion Office Furniture Systems price list dated Apr. 1983.

*Primary Examiner*—David A. Scherbel
*Assistant Examiner*—Lan Mai
*Attorney, Agent, or Firm*—Varnum, Riddering, Schmidt & Howlett

[57] ABSTRACT

A work space management system for dividing a room into separate work areas comprising a wall system having a rigid framework formed of rigid rectangular frames rigidly joined together at the edges thereof to form at least one work area with one side of at least one portion of the rigid framework defining a hallway wall. On the worker area side of the framework a plurality of modular primary tiles are removably hung on the rectangular frames and have a width corresponding to the width of the rectangular frame. On the hallway side of the framework, extended tiles are of a length which is a unit multiple greater than one of the width of a rectangular frame.

13 Claims, 4 Drawing Sheets

WORK SPACE MANAGEMENT SYSTEM HALLWAY WALL ARRANGEMENT

TECHNICAL FIELD

This invention relates in general to work space management systems, and most particularly to improvements in the hallway wall defining portion of such systems.

BACKGROUND ART

Open-plan office systems, pioneered by Herman Miller, Inc. more than 20 years ago, provide a series of rigid panels which, in turn, are connected together at facing edges to divide work spaces into work or task areas. The panels are quickly and easily coupled together at facing edges for straight line, angled coupling or multiple wall coupling. A new wall system for open plan and other office environments is disclosed in the U.S. Pat. No. 4,685,255 to Kelley et al., granted Aug. 11, 1987.

The wall system of U.S. Pat. No. 4,685,255 comprises a rigid framework formed of rigid rectangular frames rigidly joined together at the edges thereof and modular interchangeable tiles which are removably mounted to the face of the frames on both sides thereof. All panels are disclosed as having a width substantially equal to the width of the frames. Vertical rows of slots for supporting furniture hanging brackets are provided on the frames outside the location of the tiles for hanging functional furniture from the frames.

In office installations, hallways result from the layout of the wall system. The vertical repeating pattern of the tiles is sometimes less desirable in the hallways than in the offices for functional and aesthetic reasons. The vertical slotting is not needed in the hallways. The vertical repeating pattern may be less desirable to some from a visual perspective in the hall than in the office. More uniformity may be preferable in the hallways.

SUMMARY OF THE INVENTION

According to the invention, a work space management system divides a building space into a work space and a hallway and comprises a rigid framework formed of rigid rectangular frames rigidly joined together at the edges thereof. The rigid framework defines at least one work area wall portion and one hallway wall portion. A plurality of wall-defining primary tiles are removably mounted to the faces of the framework in the work area wall portion. The primary tiles have a common height and a width substantially equal to the width of the frames on which they are mounted and are interchangeable with one another. A plurality of wall-forming extended modular tiles are mounted to the frames of the hallway wall portions. The extended tiles have a common height and a length which spans at least two of the frames on which they are mounted. Each of the extended tiles is preferably of a length which is a multiple unit of the width of the rectangular frames. Further, each of the extended tiles is preferably of a height equal to, or a unit multiple of, the height of the primary tiles.

Baseline wire management means are provided at least on the hallway side of the framework for enclosing communication and/or power wires. The baseline wire management means are secured to the base of at least some of the rectangular frames. Preferably, the baseline wire management means is of a length equal to a unit multiple greater than one of the width of the rectangular frames and preferably is of a length equal in length to the extended tiles. In a typical installation, the heights of the primary and extended tiles are equal.

The frame-spanning extended tiles have the same attaching means as the regular-size primary tiles although additional attaching means can be provided at central locations on the frame-spanning extended tiles to attach to the framework between the ends of the tiles. The attaching means for the tiles will be of the type disclosed in U.S. Pat. No. 4,685,255.

BRIEF DESCRIPTION OF THE INVENTION

The invention will now be described with reference to the accompanying drawings in which.

Figure 3:
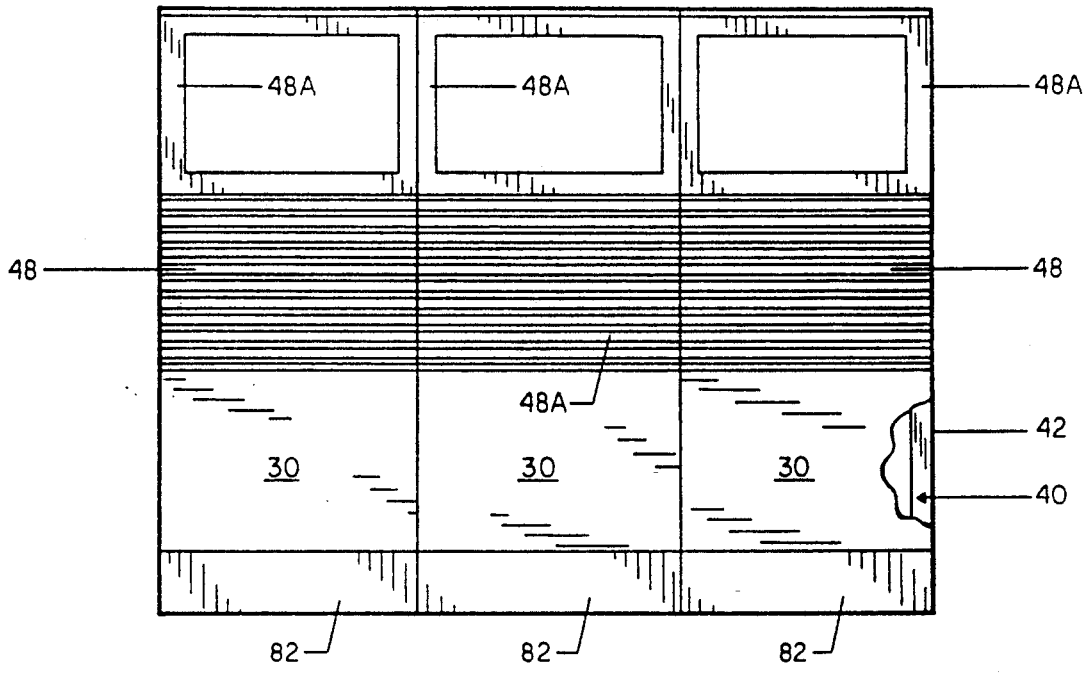
FIG. 3 (PRIOR ART)

FIG. 3 is an elevational view of a typical interior office wall in accordance with U.S. Pat. No. 4,685,255.

Figure 4:
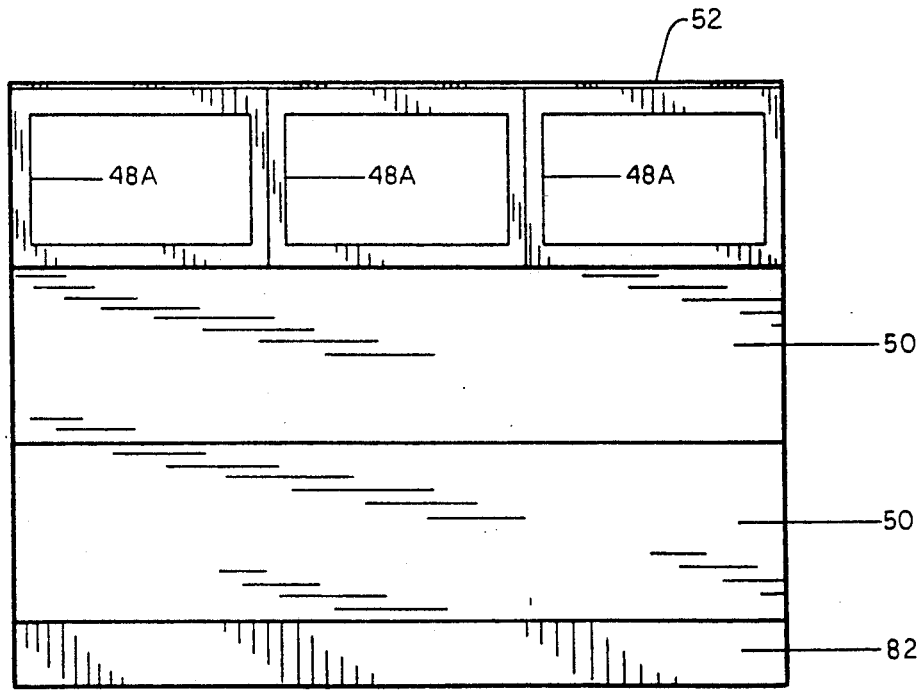

FIG. 4 is an exterior aisle wall or hallway wall on the opposite sides of the interior office wall of FIG. 3 incorporating the invention.

Figure 5:
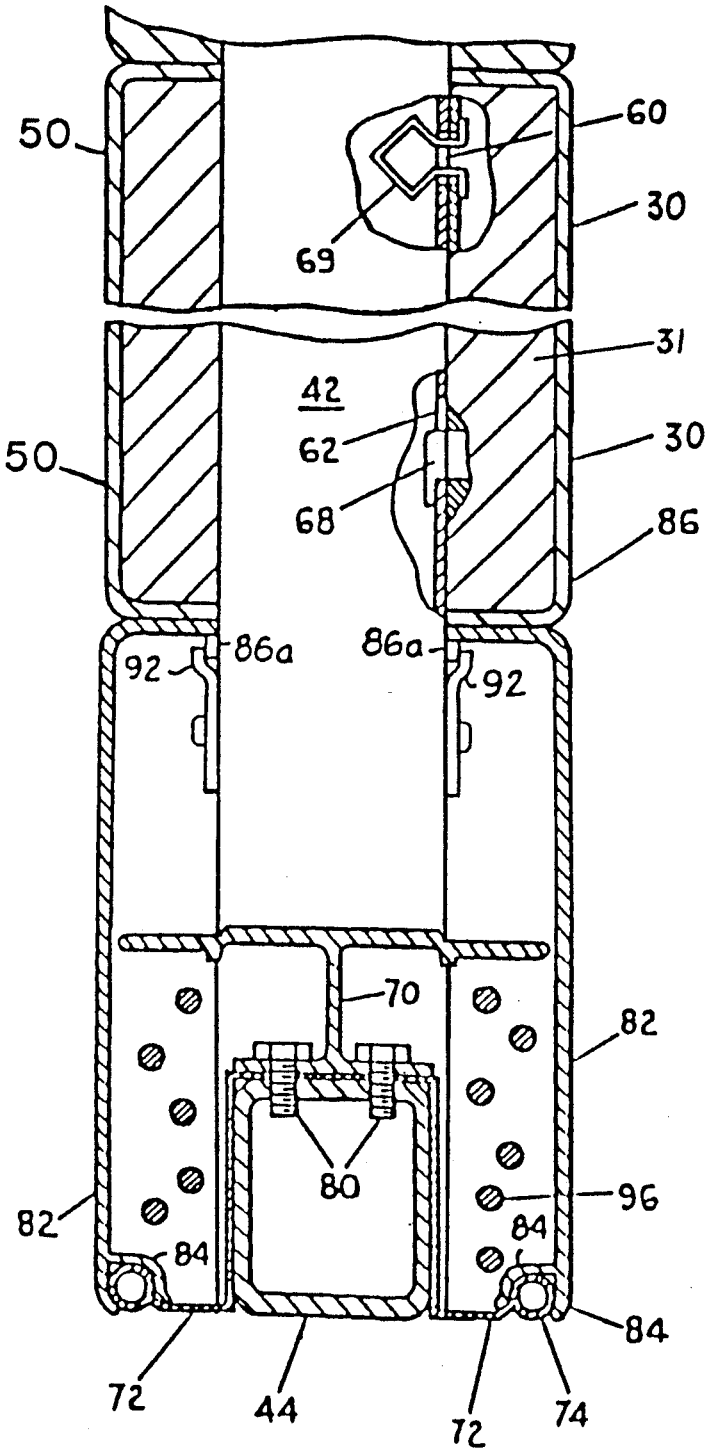

FIG. 5 is a fragmentary vertical sectional view with parts broken away and shown in section illustrating the preferred manner of attaching tiles to the rectangular frames.

BEST MODE FOR CARRYING OUT THE INVENTION

Figure 1:
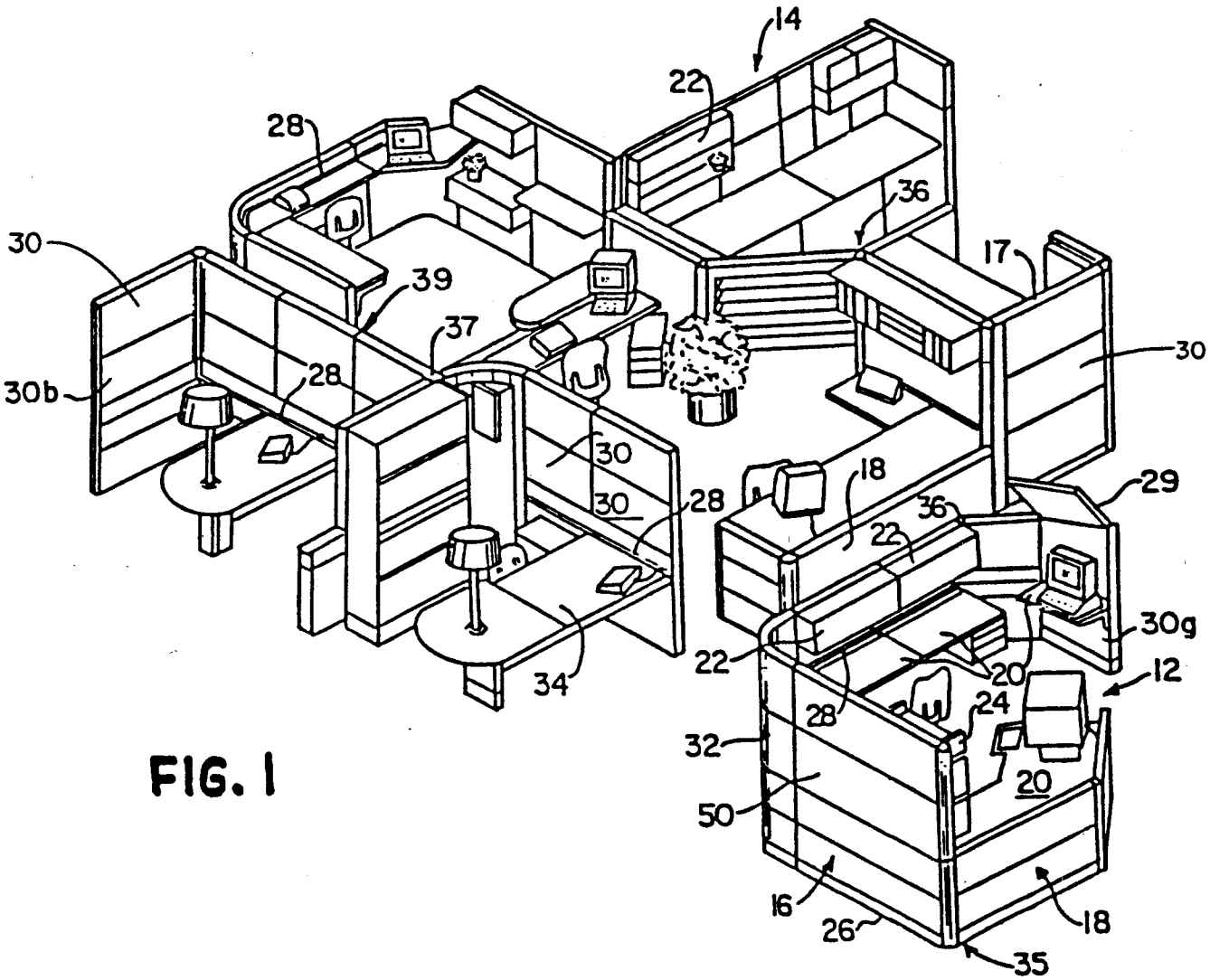
FIG. 1 is a perspective view of an office environment showing a wall panel system according to U.S. Patent No. 4,685,255, but modified in accordance with this invention.

Referring now to FIG. 1, there is shown an office environment having a single work station 12, and a multiple work station 14. Standing height walls 16 and short walls 18 define the single work station. Work surfaces 20 are mounted on the walls 16 in cantilevered fashion. Hanging cabinets 22 and shelves 24 are also supported by the walls 16. The walls are formed from primary modular tiles 30, curved tiles 32 and extended tiles 50. A baseboard wire management assembly 26 is provided at the base of each of the walls and a waistline wire management assembly 28 is provided at a midpoint in the walls in selected locations. A slanted panel 29 having an acoustical material is provided as an extension to one portion of one of the walls 16.

The multiple work station 14 is of a similar nature and is formed by standing-height walls 16 and short walls 18 which are interconnected. Work surfaces 20, hanging cabinets 22 and shelves 24 are also provided on these walls. In addition, both baseboard wire management assemblies 26 and waistline wire management assemblies 28 are provided in selected locations. A table 34 can be partially supported by the walls and has an outboard support beneath the outer end thereof. Ninety-degree joints 35, 120° joints 36 and T-wall connections 37 are formed between various panels as desired. Further, straight-wall connections 39 are formed between both straight-wall and curved-wall sections.

Figure 2:
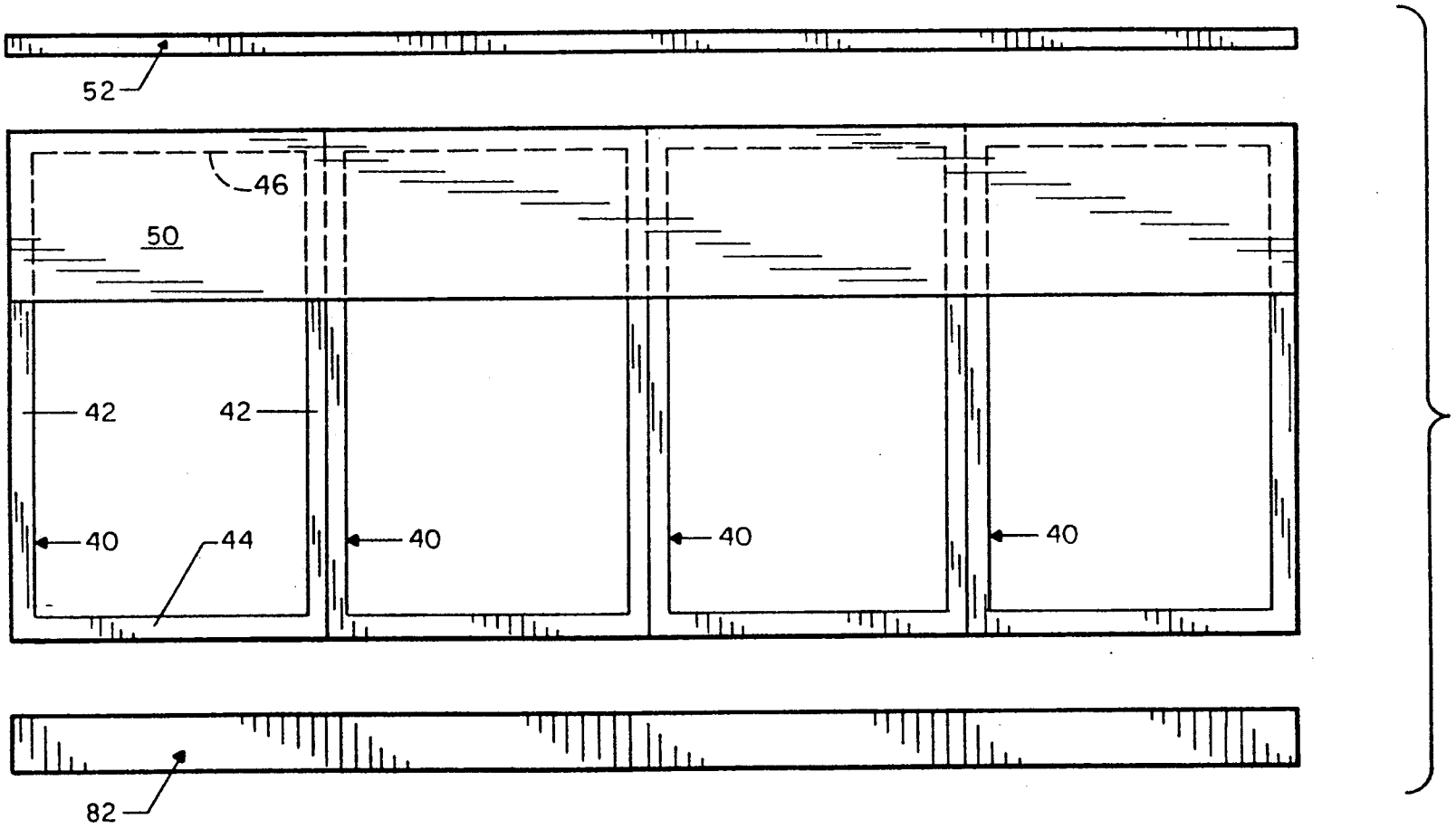
FIG. 2 is an exploded elevational view showing the relationship of a top cap, a tile and a wire management cover with respect to a plurality of rigidly connected together rectangular frames in accordance with this invention.

Referring now to FIG. 2, it will be seen that a typical wall section is formed of a plurality of rectangular frames 40. Each frame 40 comprises a pair of identical vertical members 42 welded to horizontal members 44 and 46. The frame members need not have a furniture grade finish and can be formed by roll-forming or other suitable metal-forming techniques. The frames 40 are preferably identical to the frames disclosed in the aforementioned U.S. Pat. No. 4,685,255.

Referring to FIG. 3, on the work station side of a typical rigid frame formed of a plurality of the rectangular frames 40, there are removably secured to the frames 40 equal height and size primary tiles 30. The term "tile" is used to designate a modular size, removable panel which hangs on the outside surfaces of the frames 40, thereby leaving the interior of the frames open. Each of the tiles 30 normally will be of identical height but may have different outer surfaces or may have acoustical treatment in an interior thereof. For example, the outer surface of the tile 30 may be covered with a fabric or vinyl material or wood veneer, or can even be painted. The tiles can be formed from a metal pan, turned inwardly at the edges and covered or painted as desired. Acoustic insulation 31 can be provided within the metal pan as shown in FIG. 5, if desired. Typically, the tiles 30 have a height of about 16" and a width substantially the width of one of the frames 40. The frames 40 can vary between standard widths.

The manner of removably securing the tiles 30 to the rectangular frames 40 is shown in FIG. 5 in which the vertical frame members 42 and the tiles 48 are partially broken away. Each tile 30 has a pair of hook-shaped clips 68 secured to a bottom portion thereof in spaced relationships. The clips 68 project rearwardly from the tile 30 and are located to register with a rectangular opening 62. The tile 30 further has mounted thereto a pair of rearwardly projecting spring clips 69 spaced to register with a set of square holes 60 in the vertical frame members 42. The spring clips 69 are flexible in a vertical direction to squeeze through the square holes 60 and lodge behind the edges of the opening 60 as illustrated in FIG. 5. Thus, the tiles are easily mounted on the frames 40 by placing the hook-shaped clips 68 in the rectangular openings 62 while tilting the tile 30 outwardly so that an opening 62 is visible during this operation. The tile is then rotated upwardly until the frame clips 69 pass through and are lodged behind the opening 60.

Referring once again to FIG. 5, it will be seen that an I-shaped bracket 70 is secured to the top of the lower horizontal member 44 by way of rivets or bolts 80. An elongated chase 72 is captured between the I-shaped bracket 70 and the horizontal member 44. The elongated chase 72 extends across the top and down each side of the horizontal member 44, extending outwardly thereof and defining a hinge-forming tube 74 at the outer end thereof. The hinge-forming tube 74 extends laterally in overlapping relation to the vertical members 42 and has an attaching flange (not shown) which is secured by a screw to the associated frame 40.

A hinged cover 82 has at the bottom portion thereof socket-forming flanges 84 which receive the hinge-forming tube 74 to pivotally mount the hinged cover 82 to the elongated chase 72. An inwardly directed flange 86 at the top of the hinged cover 82 fits beneath the tiles 30 and extends to the frame member 42. A cover retainer 92 is mounted to the vertical frame member 42 and has a retaining flange at a top portion thereof. The inwardly directed flange 86 has a downwardly extending projection **86*a* which is snap-fit with the retainer 92 to hold the hinged cover 82 in place in front of the elongated chase 72**.

It is to be understood that suitable wiring 96 can be laid in the elongated chase 72 behind the hinged cover 82. The cover 82 can be described as and functions as a wire management cover.

Referring now to FIG. 3, it will be seen that there is illustrated the work area side of a typical wall section. At the bottom of each of the rectangular frames 40 there will be the wire management cover 82. Above the wire management cover 82, there is a typical standard primary tile 30. Above the tile 30 there is a rail tile 48 which is provided with a plurality of horizontal rails as shown in FIG. 3. Further, above the tile 48 there is a glazed or window tile 48A which is provided with a window. The glazed or window tile can be constructed in accordance with U.S. Pat. No. 4,876,835, issued Oct. 31, 1989.

As pointed out above, each of the tiles 30, 48 and 48A will be of a length equal to the width of a rectangular panel 40. On the other hand, in accordance with this invention, on the hallway side of the framework, there may be tiles 50 which have a length equal to the length of the wall section with each tile 50 having a length which is a unit multiple greater than one of the width of a rectangular frame 40. For example, as shown in FIG. 4, the tile 50 has a length equal to the width of two of the rectangular frames 40.

The tiles 50 can be of the same height as the standard tiles 48. Thus in a typical standing-height panel section, there can be three of the tiles 50. Alternatively, the heights of the tiles 50 can be multiples of the height of tiles 30.

On the other hand, if the wall is to have windows therein, such as the window tiles 48A, then the top part of the hallway wall can also be formed of window tiles 48A.

At the base of the hallway wall there will be the usual wire management cover 82. However, instead of it being in short lengths, it will be of the same length as the tiles 50.

Referring once again to FIG. 2, it will be seen that if the wall is formed of four rectangular frames 40, for example, then the length of the tiles 50 will be increased so as to be four times the width of a rectangular frame 40. In a like manner, as is apparent from FIG. 2, even the top tile can be of a full length type.

In addition, the wire management cover 82 will be the full length of the wall section. There can also be provided a top cap 52 which telescopes down over the wall section after the tiles have been applied to the opposite faces thereof.

The tiles 50 can come in different options as previously described. Most particularly, these options would be veneer covered or fabric covered.

Reasonable variation and modification are possible within the scope of the foregoing disclosure and drawings without departing from the spirit and scope of the invention which is defined in the appended claims.

The embodiments of the invention in which an exclusive property or privilege is claimed are defined as follows:

1. A work space management system for dividing a building space into a work space and a hallway, said system comprising a rigid framework formed of rigid rectangular frames rigidly joined together at edges thereof, said rigid framework defining at least one work area wall portion and one hallway wall portion, a plurality of wall-defining primary tiles removably mounted to the faces of said framework in the work area wall portion, said primary tiles having a common height and a width substantially equal to the width of the frames on which they are mounted and are interchangeable one with another, a plurality of wall-forming extended tiles mounted to the frames on the hallway wall portion, said extended tiles having a related height and a length which spans at least two of said frames on which they are mounted.

2. A work space management system according to claim 1 wherein said extended tiles are of a length which is a multiple unit of the width of said rectangular frames.

3. A work space management system according to claim 2 wherein each of said extended tiles is of a height equal to, or a multiple of, the height of said primary tiles.

4. A work space management system according to claim 1 wherein said extended tiles are of a length which is a multiple unit of the width of said rectangular frames and of a height equal to, or a multiple of, the height of said primary tiles.

5. A work space management system according to claim 1 wherein there is at least on the hallway side of said framework baseline wire management means for enclosing communication and/or power wires secured to a base of at least certain of said rectangular frames.

6. A work space management system according to claim 5 wherein said baseline wire management means is of a length equal to a unit multiple greater than one of the width of said rectangular frames.

7. A work space management system according to claim 5 wherein said baseline wire management means is of a length equal to a unit multiple greater than one of the width of said rectangular frames, and equal in length to said extended tiles.

8. A work space management system according to claim 1 wherein the height of said primary and extended tiles is equal.

9. A work space management system for dividing a building space into a work space and a hallway, said system comprising a rigid framework formed of rigid rectangular frames rigidly joined together at edges thereof, said rigid framework defining at one side thereof a hallway wall portion, a plurality of wall-defining extended tiles secured to said hallway side of said framework, each of said tiles being of a length equal to a unit multiple greater than one of the width of said rectangular frames.

10. A work space management system according to claim 9 wherein each of said extended tiles is of a height substantially equal to a fractional unit of the height of said rectangular frames.

11. A work space management system according to claim 9 wherein there is on the hallway side of said framework baseline wire management means for enclosing communication and/or power wires secured to base of at least certain of said rectangular frames.

12. A work space management system according to claim 11 wherein said baseline wire management means is of a length equal to a unit multiple greater than one of the width of said rectangular frames.

13. A work space management system according to claim 11 wherein said baseline wire management means is of a length equal to a unit multiple greater than one of the width of said rectangular frames, and equal in length to said extended tiles.

* * * * *